United States Patent [19]

Garbuio

[11] 3,939,582

[45] Feb. 24, 1976

[54] SKI BOOT WITH FLEXIBLE INTERCONNECTED TOP AND BOTTOM PORTIONS

[76] Inventor: Carlo Garbuio, Volpago Del Montello, Treviso, Italy

[22] Filed: Aug. 22, 1974

[21] Appl. No.: 499,405

[30] Foreign Application Priority Data

Oct. 4, 1973 Italy ..... 29731/73

[52] U.S. Cl. ..... 36/2.5 AL

[51] Int. Cl.[2] ..... A43B 00/00

[58] Field of Search ..... 36/2.5 R, 2.5 AL

[56] References Cited

UNITED STATES PATENTS 3,593,435 7/1971 Lange ..... 36/2.5 AL 3,619,914 11/1971 Hanson et al. ..... 36/2.5 AL

FOREIGN PATENTS OR APPLICATIONS 1,804,834 3/1970 Germany ..... 36/2.5 AL

*Primary Examiner*—Patrick D. Lawson

*Attorney, Agent, or Firm*—Karl F. Ross; Herbert Dubno

[57] ABSTRACT

A ski boot, integrally molded from polymeric material, has a base or bottom portion and a leg or top portion interconnected at the heel by a flexible link which is corrugated and therefore extensible over the major part of its width. Lateral flaps on the leg and on the base carry coating snap fasteners which interengage on a horizontal pivotal axis in the region of the ankle, the extensible link being substantially tangent to an imaginary circle centered on that axis.

5 Claims, 3 Drawing Figures

SKI BOOT WITH FLEXIBLE INTERCONNECTED TOP AND BOTTOM PORTIONS

FIELD OF THE INVENTION

My present invention relates to a ski boot molded from polymeric sheet material.

BACKGROUND OF THE INVENTION

It has already been proposed to make such molded ski boots in two parts, i.e. a top portion or shank and a bottom portion or base, which are produced in separate molding operations and are assembled with the aid of snap fasteners giving these portions limited independent mobility against the force of an elastic linkage interconnecting the two portions, this linkage determining the normal position of the shank (usually slightly inclined to the vertical) with reference to the base.

The separate molding operations and the subsequent assembly of these portions considerably increase the manufacturing costs of such boots compared with boots of the so-called monoblock type made in one piece. The latter, on the other hand, are not nearly as comfortable in use and greatly restrict the mobility of the foot at the ankle. Such restriction of mobility is a serious drawback to a skier since it impedes his control of the runners.

OBJECT OF THE INVENTION

The object of my present invention, therefore, is to provide an improved ski boot which avoids the aforestated drawbacks and combines the advantages of the above-mentioned two-part and unitary molded boots.

SUMMARY OF THE INVENTION

This object is realized, pursuant to my present invention, by the provision of an integrally molded body of polymeric sheet material (e.g. a polycarbonate) whose top and bottom portions are interconnected at the heel end of the base and are further provided with overlapping lateral flaps carrying mating fastener halves which are positioned on a horizontal axis in the vicinity of the ankle upon mutual interengagement, the connection between the two portions including a vertically extensible part of the integral body.

Pursuant to a more particular feature of my invention, the extensible part is substantially tangent to an imaginary circle centered on the axis of the engaged fasteners in a vertical midplane of the boot.

This extensible part may be produced in a variety of ways, with or without a break in the continuity of the sheet material. I prefer, however, to preserve this continuity by merely distending rather than slitting that part, either after the molding process or in the course thereof. A particularly advantageous shape is a series of horizontal accordion pleats which can be formed in the mold and which may merge solidly into a pair of narrow bridges, also integral with the molded body, whose extensibility is substantially more limited than that of the accordion-pleated sheet section.

BRIEF DESCRIPTION OF THE DRAWING

The above and other features of my invention will now be described in detail with reference to the accompanying drawing in which.

SPECIFIC DESCRIPTION

Figure 1:
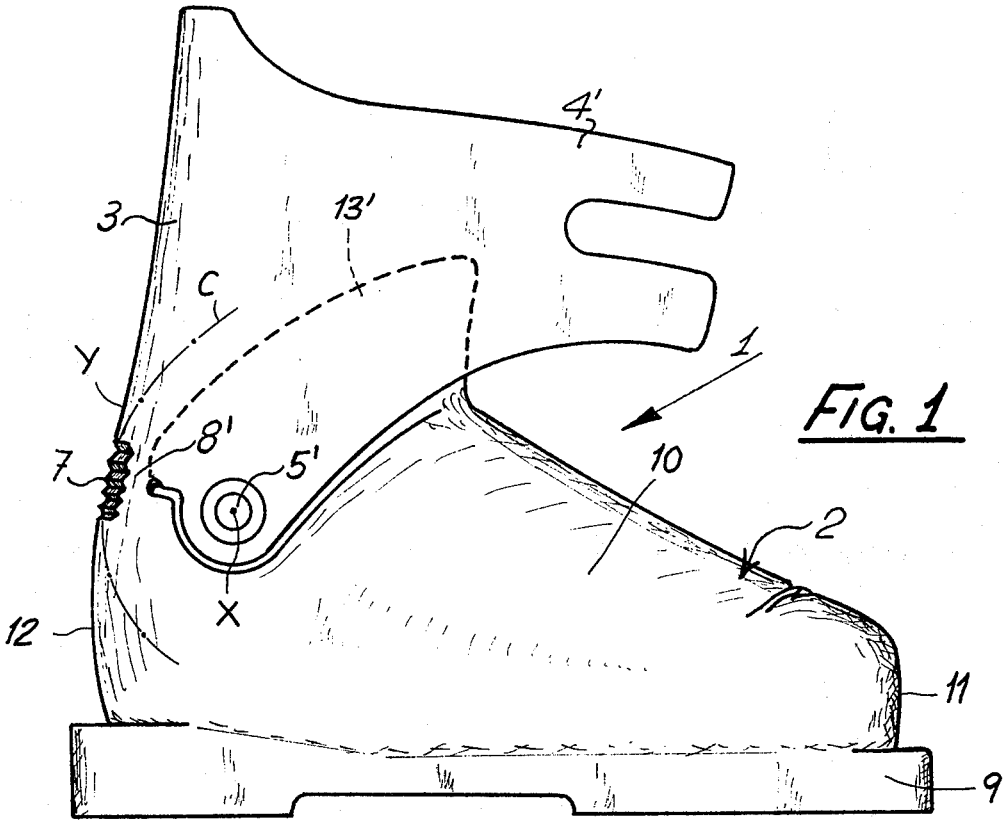
FIG. 1 is a side-elevational view of a ski boot embodying my invention.
Figure 2:
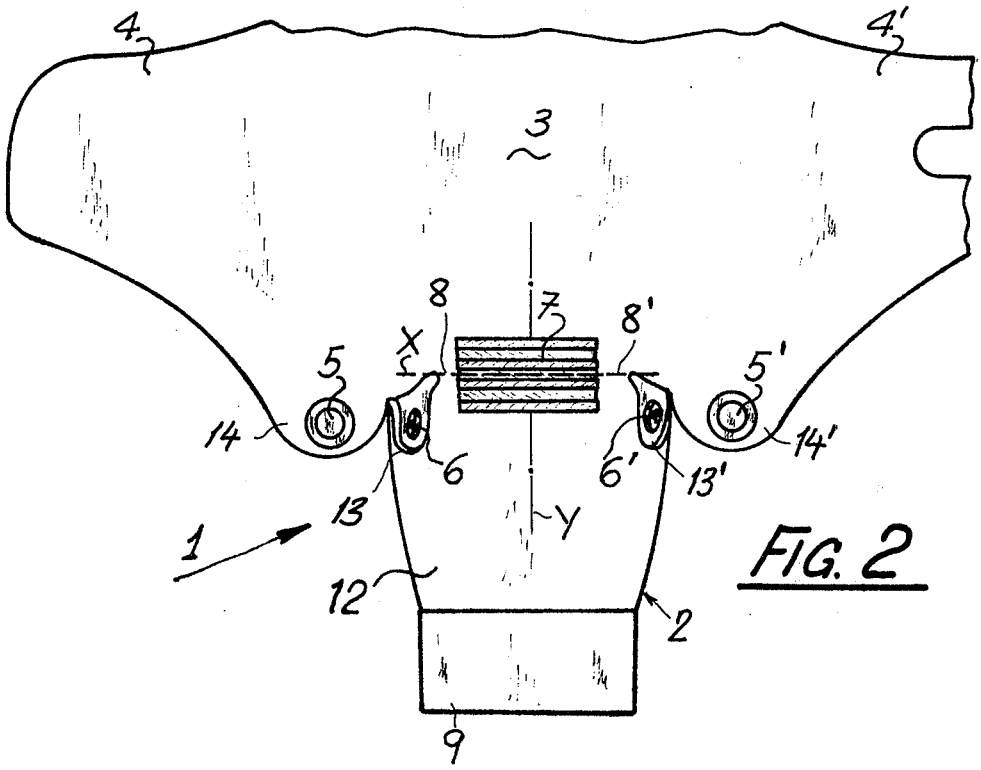
FIG. 2 is a rear view of the boot shown in FIG. 1.
Figure 3:
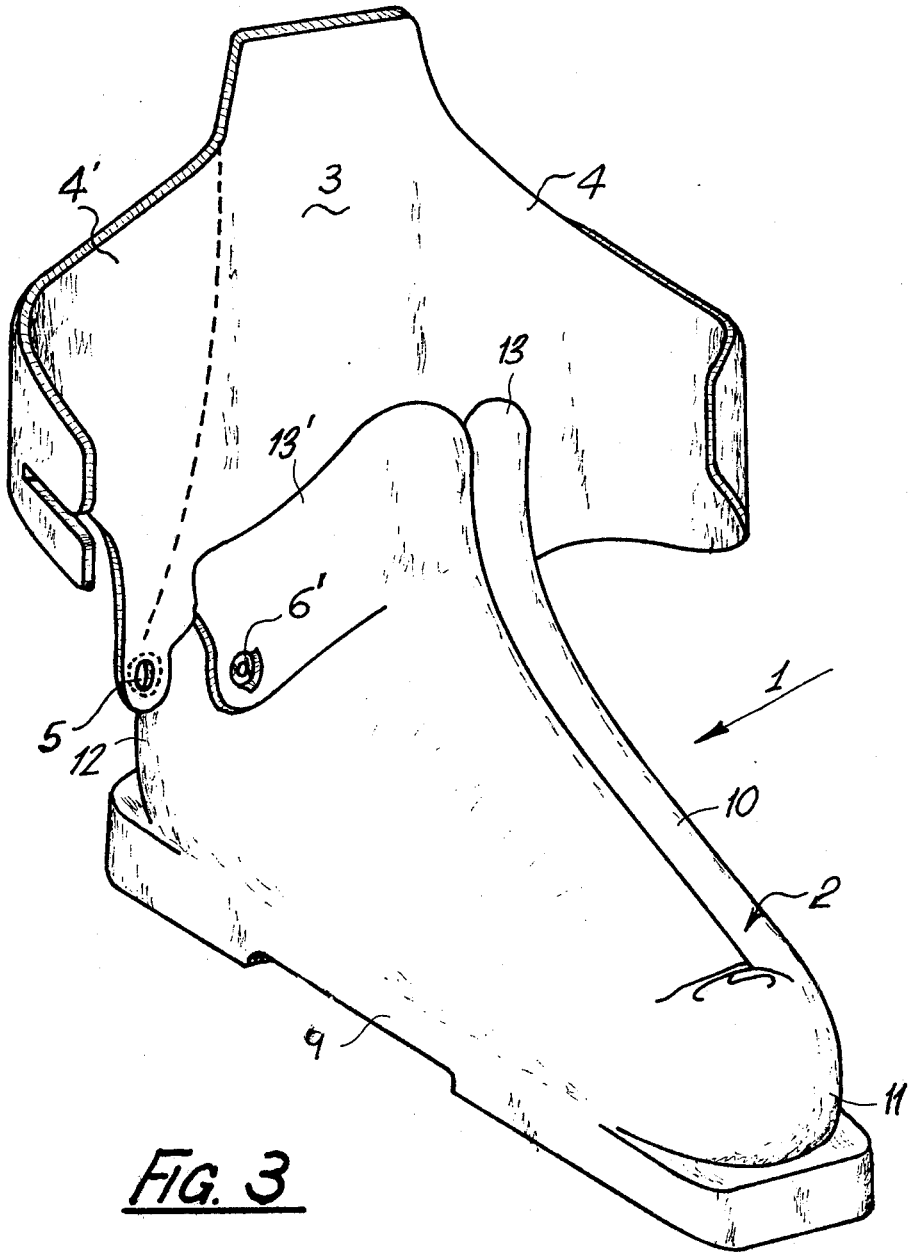
FIG. 3 is a perspective front view of the boot.

As shown in the drawing, a ski boot 1 comprises a base portion 2 and a shank portion 3 integrally molded from sheet material, the two portions being interconnected at the heel of the boot but being otherwise disjointed. Base portion 2 comprises a sole 9 and an upper or vamp 10 with tow end 11 and heel end 12, the vamp 10 being provided with a pair of rearwardly extending lateral flaps 13 and 13' bearing respective male fastener halves 6 and 6' at their extremities. Complementary female fastener halves 5 and 5' are mounted on depending lobes 14, 14' of a pair of forwardly extending lateral flaps 4 and 4' of shank portion 3. The two pairs of fastener halves, when in engagement as shown in FIG. 1, are centered on a horizontal axis X (see also FIG. 2) constituting the center of curvature of an imaginary circle C to which the centerline Y of the molded body (extending upwardly from the heel end 12 in the midplane of the last) is substantially tangent in the region of an accordion-pleated sheet section 7 located at the junction of bottom and top portions 2 and 3. The pleated part 7, flanked by two narrow bridges 8 and 8', is of generally rectangular shape when viewed from behind as in FIG. 2, with the major edges of the rectangle horizontally disposed. Actually, however, the area occupied by the vertically extensible sheet section 7 is not plane but is rearwardly convex, being curved about centerline Y so that the bridges 8 and 8' lie on the sides of the boot, close to the free ends of the rearwardly extending flaps 13 and 13' in the working position illustrated in FIG. 1. Thus, the relatively unextensible bridges 8 and 8' do not materially impede the mobility of shank 3 with reference to base 2, particularly the ability of that shank to tilt forwardly and backwardly from the position of FIG. 1.

The generally vertical minor edges of the pleated sheet section 7 have a serrated profile, as seen in FIG. 1, along which the pleats merge solidly and without discontinuity into the surrounding sheet material. Thus, no moisture or dust can penetrate into the interior of the boot at these points.

The free ends of the forwardly extending flaps 4 and 4' of shank 3 may be provided with additional fastener means not shown, such as buttons or a buckle, to hold them together above the instep of the foot.

I claim:

1. A ski boot comprising an integral body of polymeric sheet material including a bottom portion with a toe end and a heel end and further including a top portion connected with said bottom portion at said heel end by a pair of substantially inextensible lateral bridges and by a vertically extensible part flanked by said bridges, said top portion being provided with a pair of first lateral flaps extending forwardly from the region of said bridges, said bottom portion being provided with rearwardly extending second lateral flaps overlapped by said first flaps, said first and second flaps carrying mating fastener halves positioned on a horizontal axis in the region of the ankle upon mutual interengagement, said axis lying forwardly of said bridges.

2. A ski boot as defined in claim 1 wherein said extensible part is substantially tangent to an imaginary circle centered on said axis in a vertical midplane.

3. A ski boot as defined in claim 1 wherein said extensible part comprises a horizontally accordion-pleated sheet section merging solidly into said bridges.

4. A ski boot as defined in claim 1 wherein said forwardly extending flaps have depending lobes carrying their respective fastener halves.

5. A ski boot as defined in claim 1 wherein said extensible part occupies a rearwardly convex area of generally rectangular outline.

* * * * *